US007874178B2

(12) United States Patent
McConnell et al.

(10) Patent No.: US 7,874,178 B2
(45) Date of Patent: Jan. 25, 2011

(54) ABSORPTION REFRIGERATOR FLAME ARRESTOR SYSTEM

(75) Inventors: Patrick N. McConnell, Goshen, IN (US); Kenneth Anderson, Motala (SE); Carl H. Lindhagen, Motala (SE)

(73) Assignee: Dometic, LLC, Elkhart, IN (US)

( * ) Notice: Subject to any disclaimer, the term of this patent is extended or adjusted under 35 U.S.C. 154(b) by 470 days.

(21) Appl. No.: 12/027,635

(22) Filed: Feb. 7, 2008

(65) Prior Publication Data

US 2008/0190124 A1 Aug. 14, 2008

Related U.S. Application Data

(60) Provisional application No. 60/889,118, filed on Feb. 9, 2007.

(51) Int. Cl.
*F25B 33/00* (2006.01)

(52) U.S. Cl. ..... 62/497

(58) Field of Classification Search ..... 62/129, 62/476, 497

See application file for complete search history.

(56) References Cited

U.S. PATENT DOCUMENTS 4,056,947 A * 11/1977 Partsch ..... 62/148

* cited by examiner

*Primary Examiner*—Melvin Jones
(74) *Attorney, Agent, or Firm*—Pearne & Gordon LLP

(57) ABSTRACT

An ignition containment system is provided for absorption refrigeration systems. The system encloses the burner area to contain an inadvertent ignition of gases that may have escaped from the refrigerant tubing or elsewhere. By containing a potential fire or vapor leak, the system can substantially mitigate the spread of a fire to other nearby combustible materials, further damage to the appliance, and fire or smoke damage to property or materials beyond the appliance. The ignition containment system can also include an electrical detection device that can indicate an abnormal rise in temperature, a presence of foreign material, or the presence of ignitable gases in the contained or encapsulated ignition chamber. Detection of any one of the above can trigger a termination of the ignition source.

19 Claims, 10 Drawing Sheets

ABSORPTION REFRIGERATOR FLAME ARRESTOR SYSTEM

TECHNICAL FIELD

The subject application generally relates to protective devices and in particular to ignition containment devices for refrigerant or refrigerant gases in refrigerator units in order to mitigate ignition of liquid or vapor that may escape from refrigerant tubing.

BACKGROUND OF THE INVENTION

Fuel-burning appliances such as water heaters typically position an ignition control, a point of ignition, and resulting flame near the bottom of the appliance for more efficient heating. Most flammable gases are heavier than air, thus such gases, if present, can be ignited by the open flame of the appliance. Conventional protective systems for hot water heaters, in particular, have employed various techniques to prevent direct exposure of the open flame to the flammable refrigerant liquids and gases. In particular, the conventional protective system employs a perforated metal shield or flame separator to separate the flame from open exposure to ambient vapors. More recent attempts involve positioning a shield or wall around the bottom of the hot water tank, whereby the wall substantially surrounds the appliance. Unfortunately, not all fuel-burning appliances are designed or configured in a similar way. Thus, there remains a need for an effective protective device that is compatible with other fuel burning appliances such as absorption refrigerators.

SUMMARY OF THE INVENTION

The following presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

The subject application relates to an ignition containment system and method for fuel-burning devices, particularly absorption refrigerators, which are unique from other fuel-burning devices. Absorption refrigerators rely primarily on ammonia gas to operate. Should any of the ammonia gas escape from refrigerant tubing in the burner area, those vapors can ignite and cause a fire. The ignition containment system as described herein encloses the burner area to contain an inadvertent ignition of gases that may have escaped from the refrigerant tubing or elsewhere. By containing a potential fire or vapor leak, the subject system can substantially mitigate the spread of a fire to other nearby combustible materials, further damage to the appliance, and fire or smoke damage to property or materials beyond the appliance.

The ignition containment system can also incorporate an electrical detection device that can indicate an abnormal rise in temperature, a presence of foreign material, or the presence of ignitable gases in the contained or encapsulated ignition chamber. Detection of any one of the above can trigger a termination of the ignition source.

According to one aspect of the application, an ignition containment system for absorption refrigeration units is provided and includes at least a first physical encapsulation barrier comprising a sheet metal material that is of a height specific to an absorption refrigeration system, wherein the height is sufficient to substantially encapsulate a burner area of the absorption refrigeration system, and wherein at least the first physical encapsulation barrier is removably attached to the absorption refrigeration system and encapsulates the burner area to an extent that the first physical encapsulation barrier contains emissions of a gas or a liquid leaking from a pressure vessel or from refrigerant tubing for circulating refrigerant of the absorption refrigeration system.

According to another aspect of the application, an ignition containment system for absorption refrigeration units is provided which includes at least a first physical encapsulation barrier comprising a sheet metal material that is of a height specific to an absorption refrigeration system, wherein the height is sufficient to substantially encapsulate a burner area of the absorption refrigeration system, and wherein at least the first physical encapsulation barrier is removably attached to the absorption refrigeration system and encapsulates the burner area to an extent that the first physical encapsulation barrier contains emissions of a gas or a liquid leaking from a pressure vessel or from refrigerant tubing for circulating refrigerant of the absorption refrigeration system; and one or more one or more detection devices positioned at or in an area of an ignition source, a decision device, and/or a power switching function that trigger a termination an ignition or power control of the absorption refrigeration system when a threshold amount of an indicator object is detected.

To the accomplishment of the foregoing and related ends, certain illustrative aspects of the invention are described herein in connection with the following description and the annexed drawings. These aspects are indicative, however, of but a few of the various ways in which the principles of the invention may be employed and the subject invention is intended to include all such aspects and their equivalents. Other advantages and novel features of the invention may become apparent from the following detailed description of the invention when considered in conjunction with the drawings.

BRIEF DESCRIPTION OF DRAWINGS

A brief description of each drawing is as follows.

DETAILED DESCRIPTION OF THE INVENTION

Figure 1:
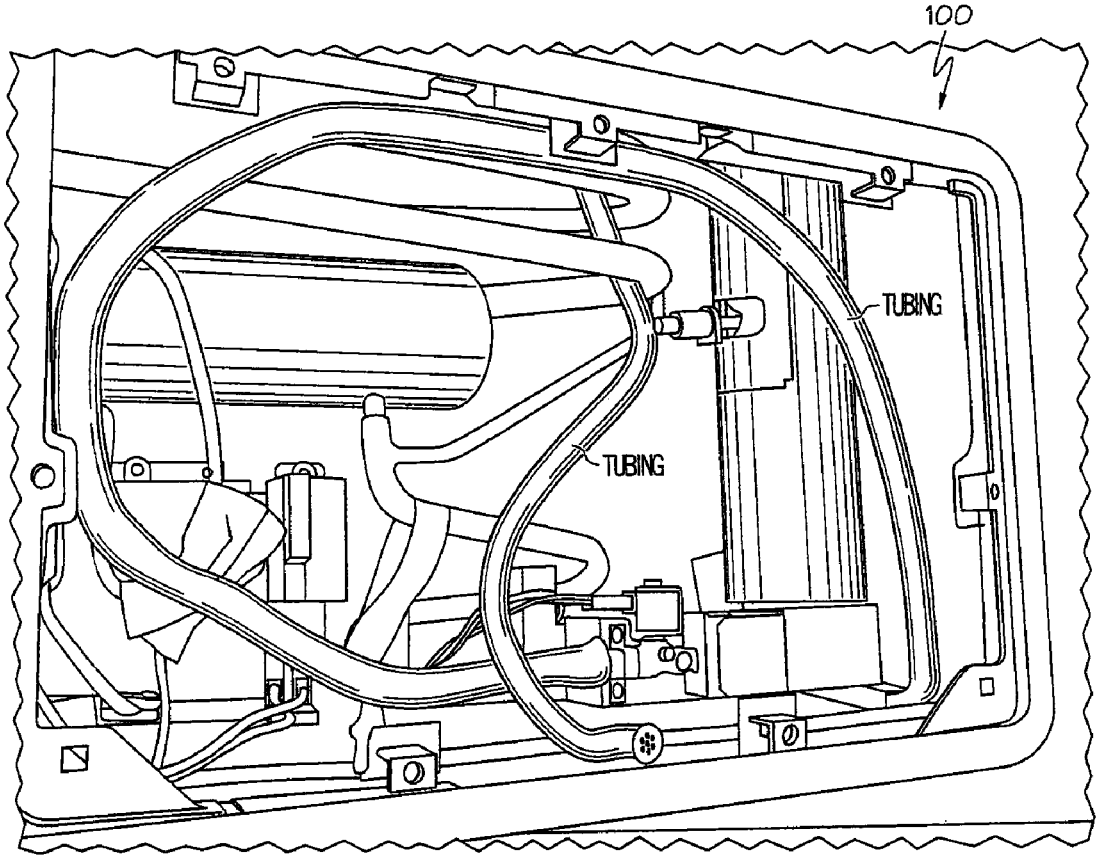
FIG. 1 is a schematic illustration of an internal view of an absorption refrigeration system as built without an ignition containment system.

The subject systems and/or methods are now described with reference to the drawings, wherein like reference numerals are used to refer to like elements throughout. In the following description, for purposes of explanation, numerous specific details are set forth in order to provide a thorough understanding of the systems and/or methods. It may be evident, however, that the subject systems and/or methods may be practiced without these specific details. In other instances, well-known structures and devices are shown in block diagram form in order to facilitate describing them.

The subject application relates to a flame or ignition containment system that by use of an installation of a metal or sheet metal part, an assembly of metal or sheet metal parts, or a combination of metal or sheet metal parts, can contain the inadvertent ignition of gases that may be present or could occur in or around the burner area of an absorption refrigerant system or other appliance dependent upon an open flame or pilot light. In particular, the system creates a safer environment for the consumer who uses absorption refrigerant systems in recreational vehicles, remote cottage locations, and residences which do not have electricity and provides fire containment techniques within the normal operation of the appliance. This system also establishes a new level of life and health safety assurance for absorption technology. In particular, the arrangement, location, and function of the parts restrict the advancement of the ignition of gases present in the area of the burner beyond the containment system to a hazardous or life threatening condition for the user of the appliance.

The containment system involves the use of a physical barrier separation to contain the spread of fire from the ignition of gases that may possibly be present at the burner during any point of the appliance's operation. There are at least two techniques. For example, a physical encapsulation barrier(s) such as sheet metal that is of a height specific to the particular appliance in order to encapsulate the burner area to an extent that it contains the emission of gases or liquid that may leak from the pressure vessel used to circulate the refrigerant of an absorption refrigerant system, which may ignite when exposed to the open flame of a burner or the competent ignition source of an electrical heater and will also provide protection against the conductance and convection of heat to adjacent combustible materials. These components could be the use of one "boiler cover", or the assemblage of several parts that could, but not necessarily be made up of a "boiler cover", "bottom plate", "heater cover", "protection plate", "back cover".

As illustrated in FIGS. 1-5, an ignition containment system as described herein can be readily installed in an absorption refrigeration system and once installed, the containment system mitigates undesirable ignition of combustible materials. This can be accomplished in part by encapsulating areas of the absorption refrigeration system that are either susceptible to an available or present ignition source or that provide the ignition source to combustible materials arising from the absorption refrigeration system or from exterior sources. As a result, inadvertent emissions of flammable or ignitable materials from the absorption refrigeration system can be contained within the refrigeration system, thereby minimizing any damage or exposure thereto. In addition, combustible materials derived from other systems, devices or appliances external to the absorption refrigeration system can be protected from an ignition source within the absorption refrigeration system.

Another example involves the use of the barrier in conjunction with but not limited to one or more electrical devices that detect or indicate an abnormal rise in temperature, the presence of foreign material, or the presence of ignitable gases in the area of the burner which trigger to eliminate the ignition source as well as contain the ignition of gases in the burner area. This type of containment system not only contains any ignition that occurs from leaking gases or liquids it also shuts down the operation of the absorption system, eliminating the ignition source to prevent the continued ignition of refrigerant leaking from the refrigerant system.

Using the physical barrier system noted in the first example above, an electrical safety shut-off device can be used to detect one or more of the following: extreme temperatures, low pressure, presence of particles of combustion, or levels of gases—and when triggered at levels known to indicate ignition, removes the original ignition source to extinguish the combustion within the containment system. The electrical device may consist of a Thermodisc, thermofuse, thermal fuse, particulate sensing, or gas level sensing detection device positioned within the containment system, at or in the area of the ignition source, a decision device, and a power switching function. The power switching function may switch off any source of power at any voltage. The power switch can, by shutting down, also terminate any source of ignition that is present. This includes all sources of supplied fuel.

Figure 2:
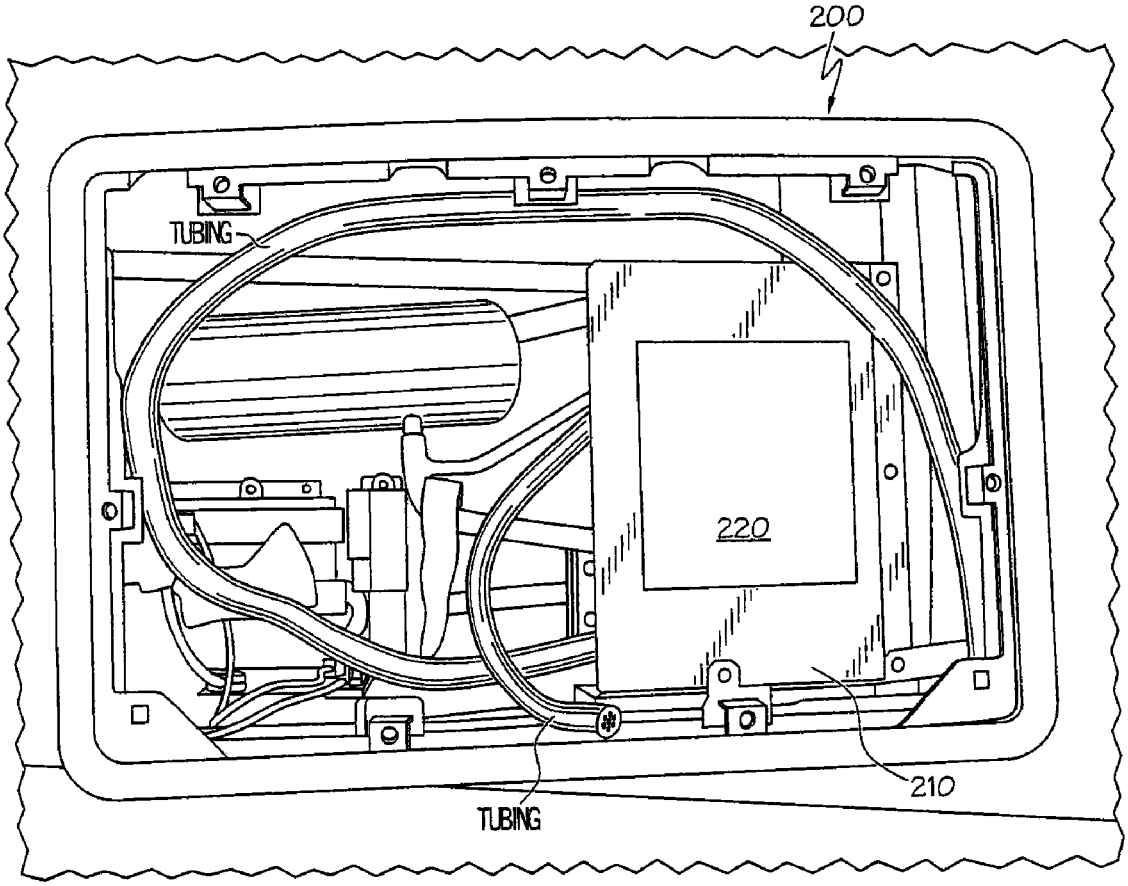
FIG. 2 is a schematic illustration of an internal view of an absorption refrigeration system modified with an ignition containment system in accordance with an aspect of the subject application.

Referring now to the figures, FIG. 1 illustrates an internal view of an exemplary absorption refrigeration system 100 which does not have an ignition containment system as described herein. By contrast, FIG. 2 illustrates an internal view of an exemplary absorption system 200 that has been modified via installation of an ignition containment system 210 according to aspect of the subject application. In FIG. 2, for example, the ignition containment system 210 comprises a back or rear cover 210, which is depicted as being removably attached to encapsulate a burner area (see FIG. 1) of the absorption refrigeration system.

Figure 3:
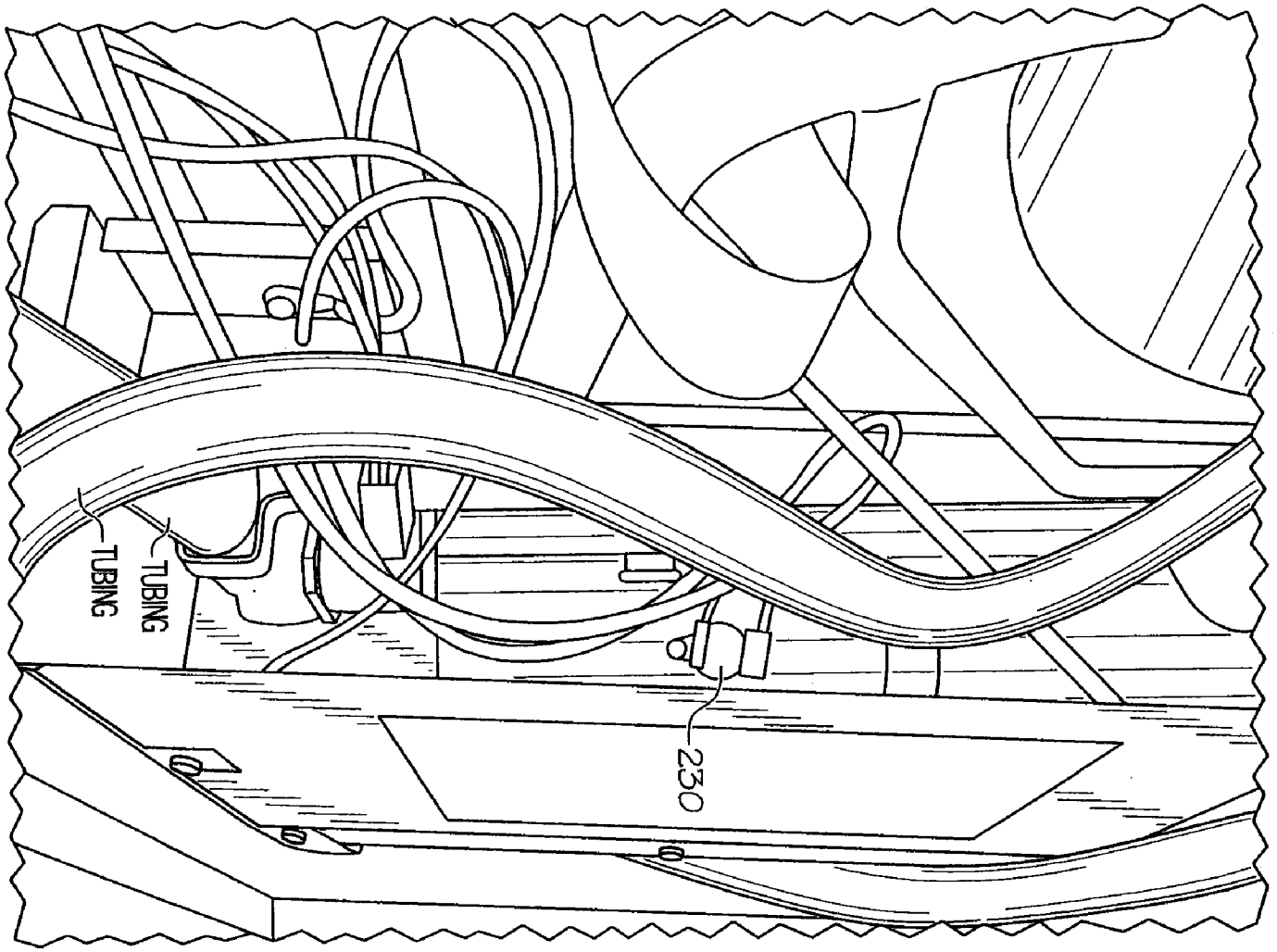
FIG. 3 is a schematic illustration of an internal view of an absorption refrigeration system as built with an ignition containment system in accordance with another aspect of the subject application.

An electrical wiring diagram 220, which is affixed to the back cover 210, can also be employed when an electrical sensing or detection device is also included in the ignition containment system. For example, FIG. 3 depicts another view of the absorption refrigeration system with ignition containment system 210. In FIG. 3, the placement of the rear or back cover 210 can be readily visualized. In addition, the ignition containment system 200 includes a thermofuse 230 (or thermal fuse). When a thermofuse is utilized in the ignition containment system, it can sense heat, and in particular, an abnormal rise in temperature given the type of absorption refrigeration system in use. When a threshold amount of heat is detected, the thermofuse can trigger an ignition switch or other ignition source connected thereto, to turn off. As a result, a possible fire or other potential damage caused by an active ignition source under these circumstances (e.g., abnormal heat build-up) is averted.

Figure 4:
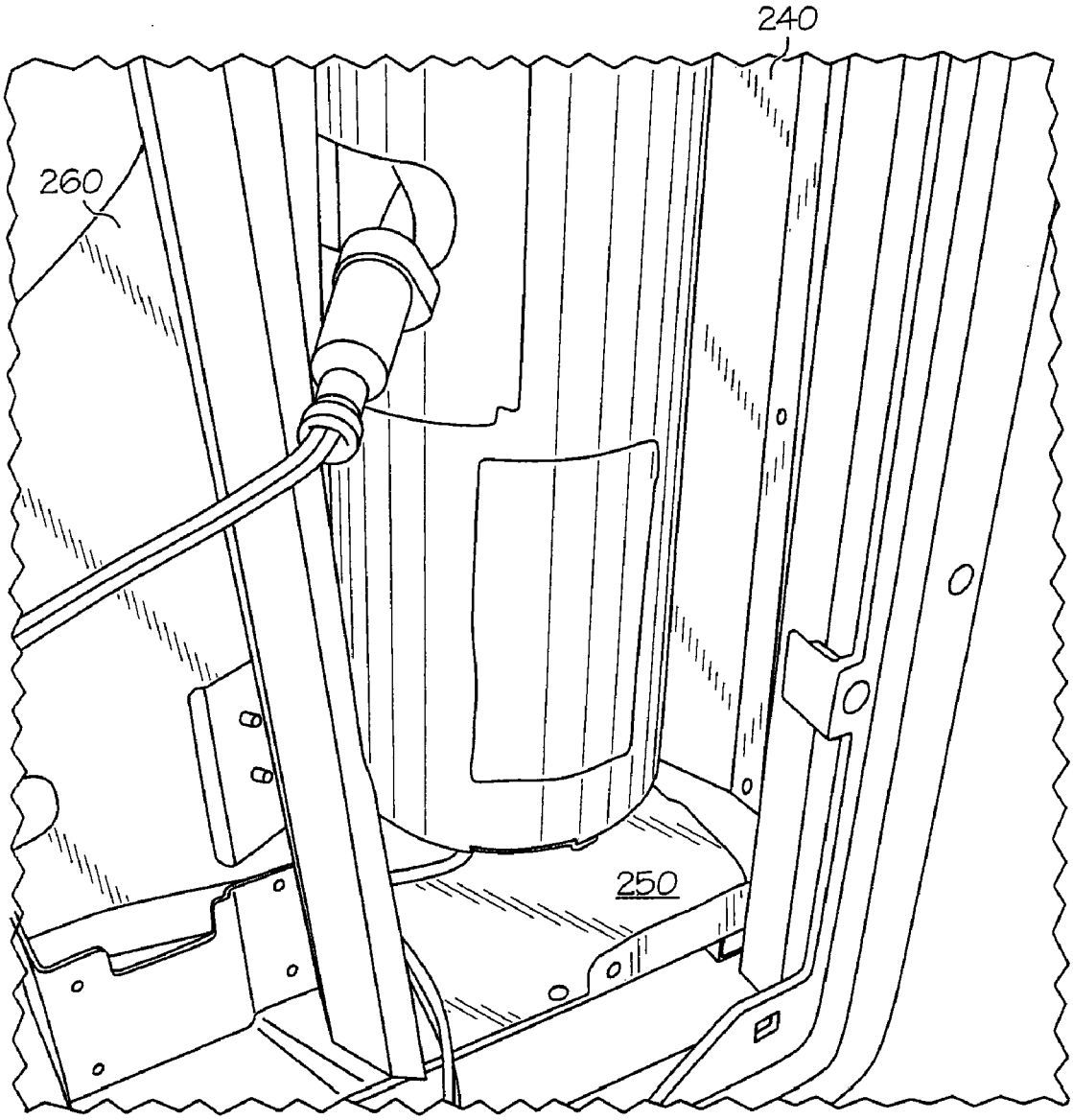
FIG. 4 is a schematic illustration of an internal view of an absorption refrigeration system as built with an ignition containment system in accordance with yet another aspect of the subject application.
Figure 5:
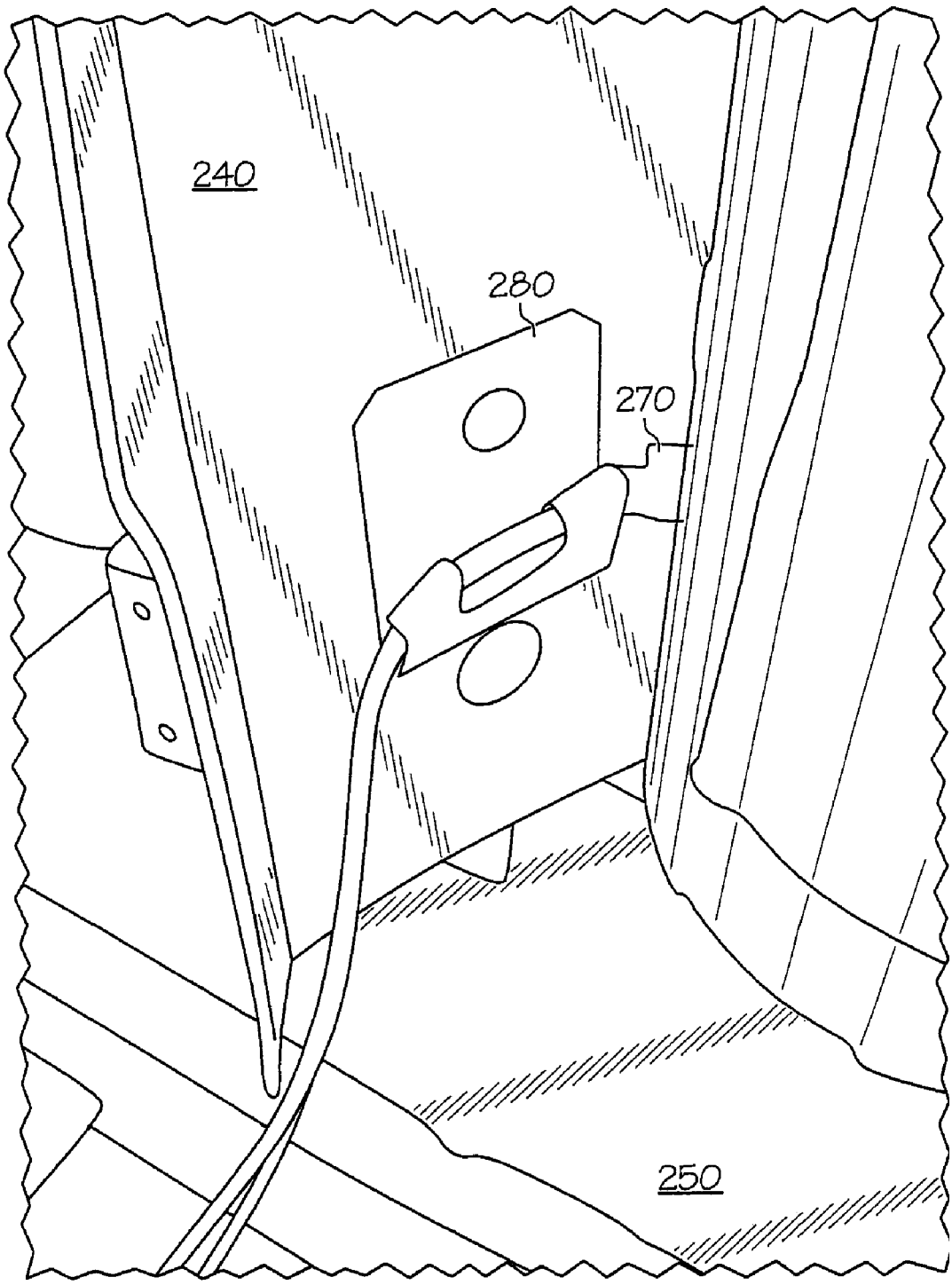
FIG. 5 is a schematic illustration of an internal view of an absorption refrigeration system as built with an ignition containment system in accordance with still another aspect of the subject application.

FIGS. 4 and 5 represent additional components of an ignition containment system as described herein. In FIG. 4, the ignition containment system comprises a boiler cover 240, bottom cover 250, and a protection plate 260. Each of these physical encapsulation barriers are removably attached to a portion of the absorption refrigeration unit in order to encapsulate portions of a burner area, boiler, or other parts of the absorption refrigeration system that involve or contain ignition sources or ignitable materials. For example, if there is a leak from tubing that circulates flammable refrigerant material, the protection plate, bottom cover, and/or boiler cover or any combination thereof can encapsulate and restrict any related damage that may occur as a result of the leak to stay substantially within the absorption refrigeration system and mitigate a spread of damage to areas beyond the refrigeration system.

FIG. 5 is a close-up view of another portion of FIG. 4, which demonstrates the installation and placement of a thermal fuse 270 near the boiler. The thermal fuse 270 can be held in place by a thermal fuse holder 280 which has been secured to the boiler cover 240 as shown. An abnormal rise in temperature near the boiler can certainly indicate a problem and if detected, any ignition sources connected to the thermofuse can be shut down.

Figure 6:
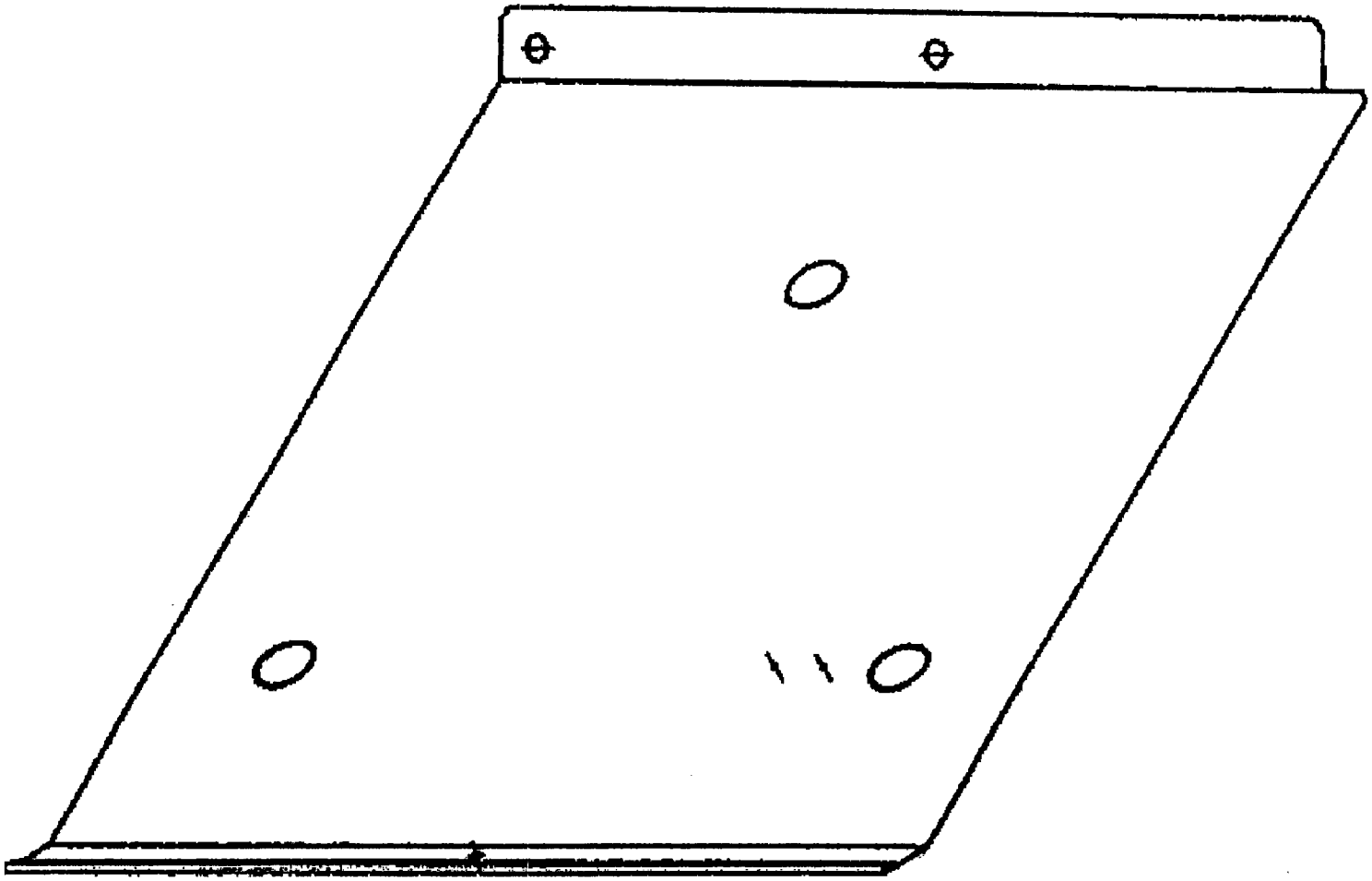
FIG. 6 is an isometric view of an exemplary boiler cover that can be used as the ignition containment system in whole or in part in accordance with an aspect of the subject application.
Figure 7:
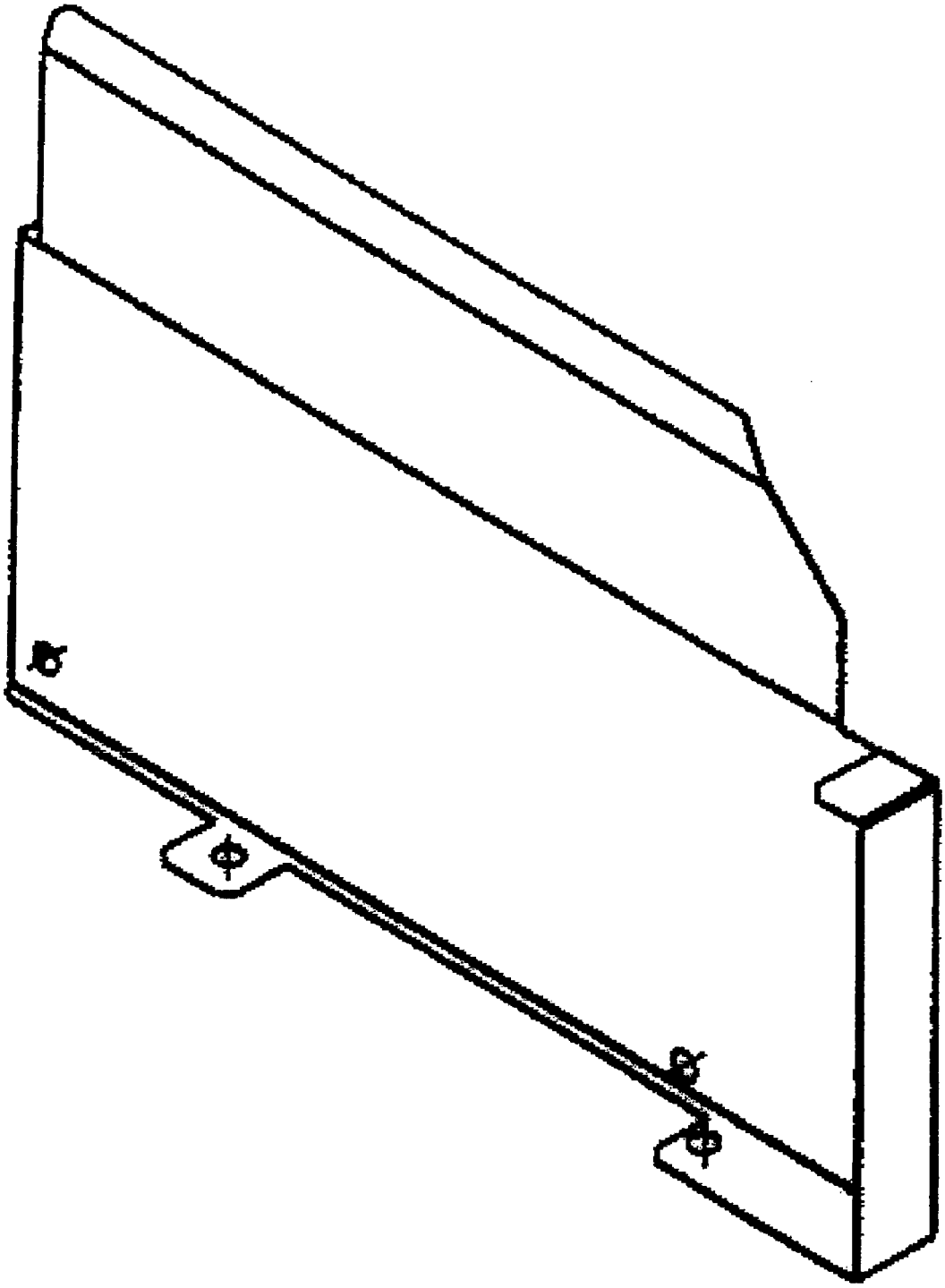
FIG. 7 is an isometric view of a bottom cover that can be employed in an ignition containment system in accordance with an aspect of the subject application.
Figure 8:
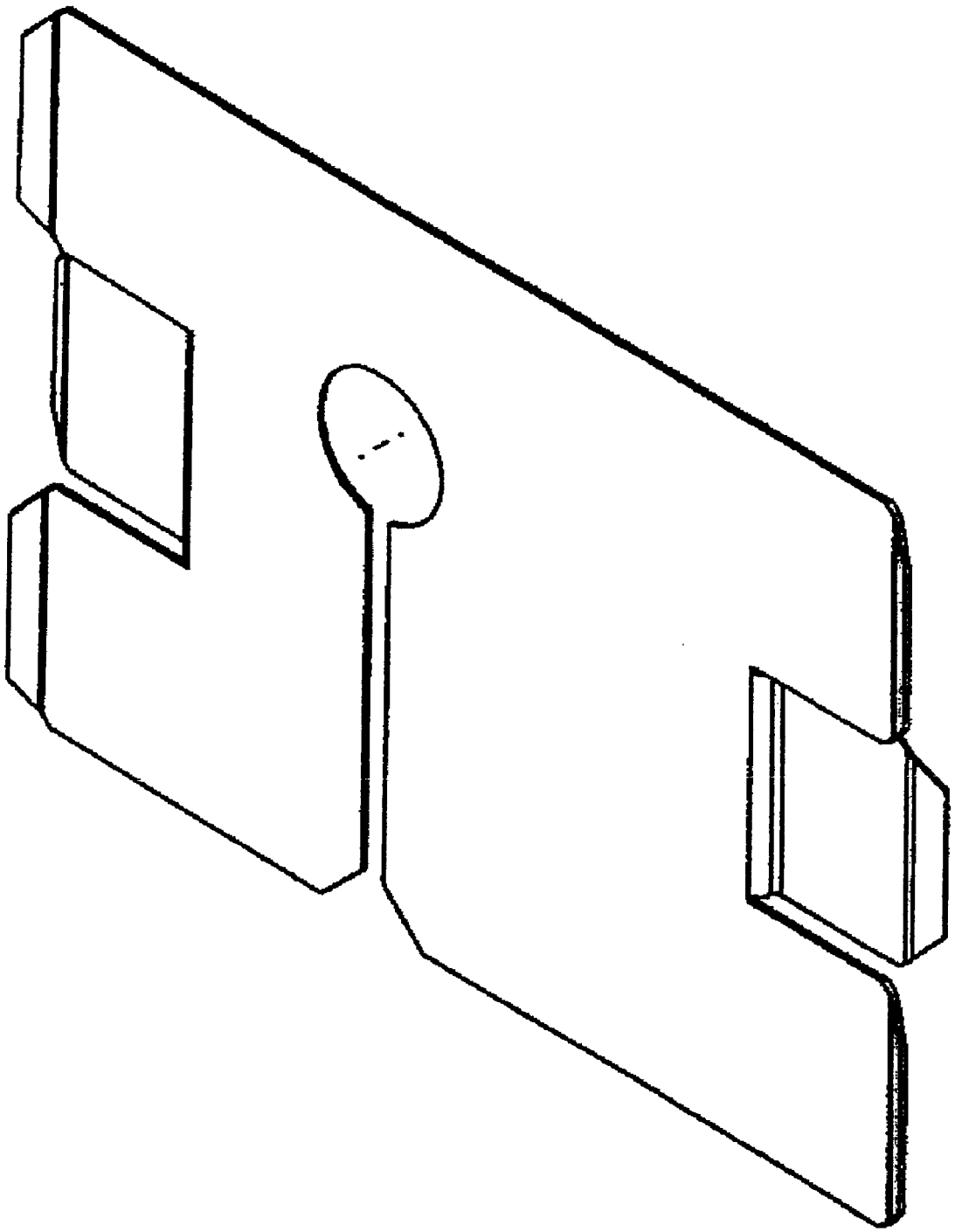
FIG. 8 is an isometric view of a plate cover that can be used as one part of an ignition containment system in accordance with an aspect of the subject application.
Figure 9:
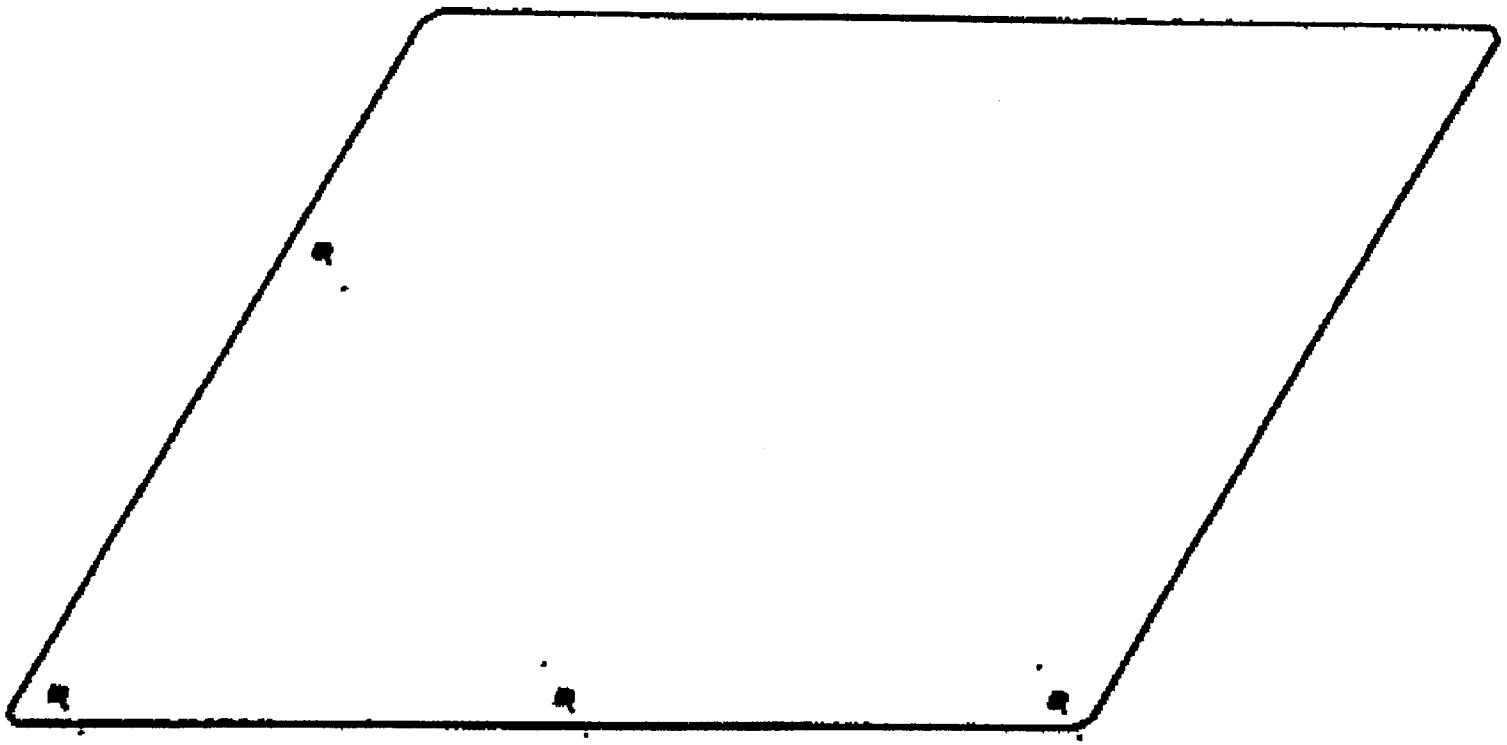
FIG. 9 is an isometric view of a rear or back cover that can be used as one part of an ignition containment system in accordance with an aspect of the subject application.
Figure 10:
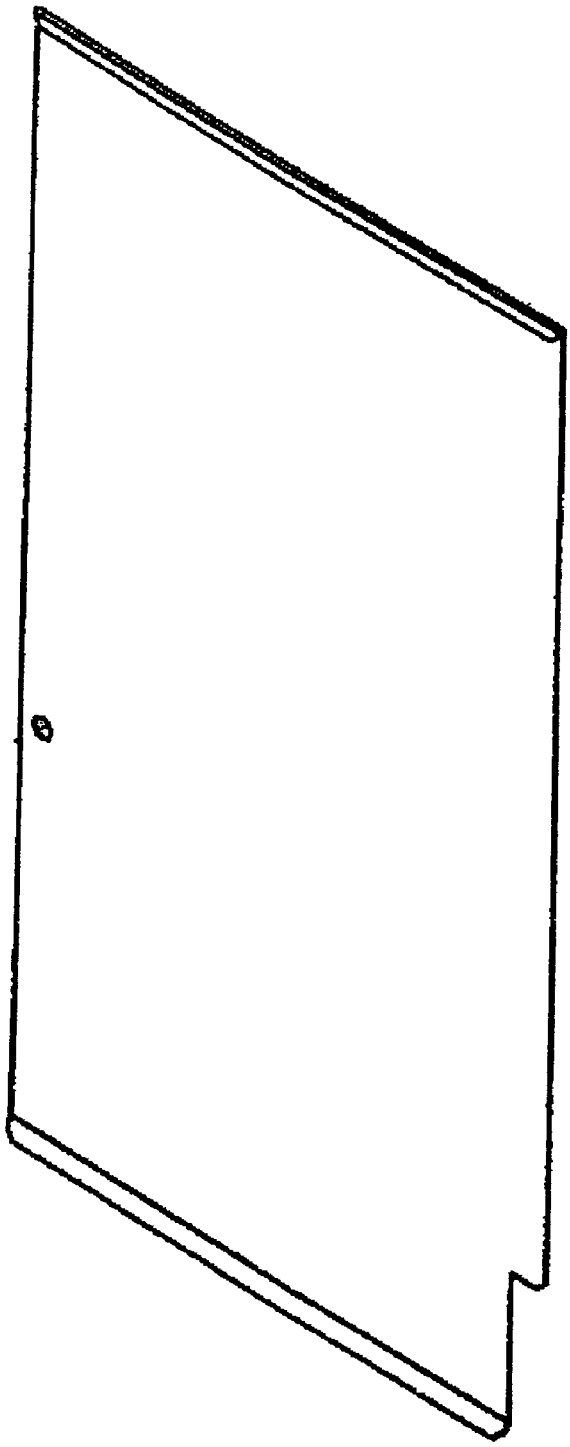
FIG. 10 is an isometric view of a back protection plate that can be used as one part of an ignition containment system in accordance with an aspect of the subject application.

Moving on to FIGS. 6-10, isometric views of various physical encapsulation barriers as described herein are illustrated. In FIG. 6, an exemplary boiler cover 300 that can be used as the ignition containment system or as a part thereof is shown. FIG. 7 depicts a bottom cover 310; FIG. 8 shows a plate cover 320; FIG. 9 illustrates a rear or back cover 330 that can be used as one part of an ignition containment system in accordance with an aspect of the subject application; and FIG. 10 demonstrates a back protection plate 340. It should be appreciated and understood that the dimensions and shapes of these physical encapsulation barriers can vary according to the size and/or internal configuration of any given absorption refrigeration system in which an ignition containment system is installed.

What has been described above includes examples of the subject system and/or method. It is, of course, not possible to describe every conceivable combination of components or methodologies for purposes of describing the subject system and/or method, but one of ordinary skill in the art may recognize that many further combinations and permutations of the subject system and/or method are possible. Accordingly, the subject system and/or method are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An ignition containment system for absorption refrigeration units comprising:

at least a first physical encapsulation barrier comprising a sheet metal material that is of a height specific to an absorption refrigeration system, wherein the height is sufficient to substantially encapsulate a burner area of the absorption refrigeration system, and wherein at least the first physical encapsulation barrier is removably attached to the absorption refrigeration system and encapsulates the burner area to an extent that the first physical encapsulation barrier contains emissions of a gas or a liquid leaking from a pressure vessel or from refrigerant tubing for circulating refrigerant of the absorption refrigeration system.

2. The system of claim 1, wherein the height of the at least one physical encapsulation barrier is sufficient to substantially encapsulate the burner area to an extent that it mitigates conductance and convection of heat to adjacent combustible materials.

3. The system of claim 1 further comprising one or more detection devices positioned at or in an area of an ignition source, a decision device, and/or a power switching function that trigger a termination an ignition or power control of the absorption refrigeration system when a threshold amount of an indicator object is detected.

4. The system of claim 3, wherein the one or more detection devices comprises a temperature detection device that detects an abnormal rise in temperature in a contained or encapsulated ignition chamber or within proximity of the ignition source.

5. The system of claim 3, wherein the one or more detection devices comprises an ignitable gas detection device that detects an amount of an ignitable gas in a contained or encapsulated ignition chamber or within proximity of the ignition source.

6. The system of claim 3, wherein the one or more detection devices comprises a foreign material detection device that detects airborne particles in a contained or encapsulated ignition chamber or within proximity of the ignition source and which are not characteristic to the absorption refrigeration system.

7. The system of claim 3, wherein the one or more detection devices comprises a thermal fuse, particulate sensing, or gas level sensing detection device.

8. The system of claim 1, wherein the at least a first physical encapsulation barrier comprises a boiler cover.

9. The system of claim 1 further comprising at least a second physical encapsulation barrier.

10. The system claim 9, wherein the second physical encapsulation barrier comprises a bottom plate cover that encloses a bottom portion of the absorption refrigeration system, which includes at least a portion of the burner area and at least a portion of refrigerant tubing containing ammonia gas and/or ammonia vapor, wherein the bottom cover mitigates an undesirable ignition of the ammonia gas and/or ammonia vapor.

11. The system of claim 9, wherein the second physical encapsulation barrier comprises a heater cover that encapsulates a heater portion of the absorption refrigeration system.

12. The system of claim 9, wherein the second physical encapsulation barrier comprises a back cover that encapsulates a rear or outward facing portion of the absorption refrigeration system which includes the at least a portion of the burner area.

13. An ignition containment system for absorption refrigeration units comprising:

at least a first physical encapsulation barrier comprising a sheet metal material that is of a height specific to an absorption refrigeration system, wherein the height is sufficient to substantially encapsulate a burner area of the absorption refrigeration system, and wherein at least the first physical encapsulation barrier is removably attached to the absorption refrigeration system and encapsulates the burner area to an extent that the first physical encapsulation barrier contains emissions of a gas or a liquid leaking from a pressure vessel or from refrigerant tubing for circulating refrigerant of the absorption refrigeration system; and one or more detection devices positioned at or in an area of an ignition source, a decision device, and/or a power switching function that trigger a termination an ignition or power control of the absorption refrigeration system when a threshold amount of an indicator object is detected.

14. The system of claim 13, wherein the one or more detection devices comprises a temperature detection device that detects an abnormal rise in temperature in a contained or encapsulated ignition chamber or within proximity of the ignition source.

15. The system of claim 13, wherein the one or more detection devices comprises an ignitable gas detection device that detects an amount of an ignitable gas in a contained or encapsulated ignition chamber or within proximity of the ignition source.

16. The system of claim 13, wherein the one or more detection devices comprises a foreign material detection device that detects airborne particles in a contained or encapsulated ignition chamber or within proximity of the ignition source and which are not characteristic to the absorption refrigeration system.

17. The system of claim 13, wherein the one or more detection devices comprises a thermal fuse, particulate sensing, or gas level sensing detection device.

18. The system of claim 13, wherein the indicator object comprises at least one of heat, a gas, a liquid, or vapors.

19. The system of claim 3, wherein the indicator object comprises at least one of heat, a gas, a liquid, or vapors.

* * * * *